US008816806B2

(12) United States Patent
Tait et al.

(10) Patent No.: US 8,816,806 B2
(45) Date of Patent: Aug. 26, 2014

(54) MAGNETICALLY COUPLED DEVICE

(75) Inventors: Michael Tait, Lititz, PA (US); Adam Davis, Lancaster, PA (US); James Fairorth, Lancaster, PA (US)

(73) Assignee: Tait Towers Manufacturing, LLC, Lititz, PA (US)

( * ) Notice: Subject to any disclaimer, the term of this patent is extended or adjusted under 35 U.S.C. 154(b) by 12 days.

(21) Appl. No.: 12/565,929

(22) Filed: Sep. 24, 2009

(65) Prior Publication Data

US 2010/0007449 A1 Jan. 14, 2010

Related U.S. Application Data

(63) Continuation-in-part of application No. 12/363,006, filed on Jan. 30, 2009, now Pat. No. 8,525,626.

(60) Provisional application No. 61/042,007, filed on Apr. 3, 2008.

(51) Int. Cl.
*H01F 7/02* (2006.01)

(52) U.S. Cl.
CPC ..... *H01F 7/0252* (2013.01); *H01F 7/021* (2013.01)
USPC ..... 335/285; 335/306

(58) Field of Classification Search
CPC ..... H01F 7/021; H01F 7/0252
USPC ..... 335/285, 302–306; 24/303
See application file for complete search history.

(56) References Cited

U.S. PATENT DOCUMENTS

| | | | | |
|---|---|---|---|---|
| 6,675,448 | B2 * | 1/2004 | Revel | 24/303 |
| 7,038,567 | B2 * | 5/2006 | Vicentelli | 335/306 |
| 2005/0102802 | A1 * | 5/2005 | Sitbon et al. | 24/303 |

* cited by examiner

*Primary Examiner* — Ramon Barrera

(57) ABSTRACT

Provided is a magnetically coupled device, a method of assembling the magnetically coupled system, and a method whereby positioning a first arrangement and a second arrangement prevents a magnetic field generated from within a first plurality of magnets and a second plurality of magnets from affecting a magnetically sensitive component.

11 Claims, 4 Drawing Sheets

MAGNETICALLY COUPLED DEVICE

PRIORITY

This application is a continuation-in-part application of Ser. No. 12/363,006, filed Jan. 30, 2009, which claimed the benefit of U.S. Provisional Application No. 61/042,007, filed Apr. 3, 2008, the disclosures of which are hereby incorporated herein by reference, in their entirety.

FIELD OF THE DISCLOSURE

The present disclosure generally relates to theatrical systems and structures for supporting the same. More specifically, the present disclosure relates to modular structures for supporting sound components and lighting components in display systems controlled by signals sensitive to magnetic interference.

BACKGROUND OF THE DISCLOSURE

When being used as part of a touring production, sound components and lighting components can be subjected to frequent attachment and detachment from physical structures. The components and/or structures may frequently be assembled and handled by individuals of varying level of skill and assembled and disassembled into larger video displays.

Fastening mechanisms for components have been used; however, they are difficult to assemble and disassemble, subject to misalignment, require a plurality of pieces, require tools for certain adjustments, do not offer adequate stability, do not have easily replaceable parts, and do not work well in conjunction with other parts of the portable structures.

Magnets are used in some industries for affixing devices to surfaces. Primarily, these devices rely solely upon the strength of the attraction of the magnet to a ferromagnetic material to hold the devices in place. These systems can have magnets that lack lateral attractive force, which permits the magnet to move up or down on a ferromagnetic surface thereby permitting relative movement between the surfaces. Although this adjustability may be helpful in some applications, this adjustability is undesirable when the magnets must be placed in a specific position with a specific orientation to provide support necessary for stages and platforms.

A permanent magnet generates a magnetic field. The magnetic field can interfere with certain signals and the operation of certain equipment. As such, it is generally undesirable to mount permanent magnets or other magnets near sensitive electronic equipment. For example, magnetic interference in the form of inductive interference may disrupt proper operation of relays, wires carrying large currents, electrical instruments, inductors, and transformers.

Therefore, there is an unmet need to provide a coupling that reproducibly and repeatably couples modular components, such as equipment for use with a theatrical or stage performance, and does not interfere with signals and/or operation of equipment sensitive to magnetic fields.

SUMMARY OF THE DISCLOSURE

One aspect of the disclosure refers to a magnetically coupled system comprising a magnetically coupled device including a first arrangement having a first plurality of magnets disposed in a first housing, the first arrangement being attractable and alignable to a second arrangement having a second plurality of magnets disposed in a second housing, and the first arrangement being configured to detachably engage the second arrangement in at least one predetermined orientation or position. In this aspect, positioning of the first plurality of magnets and the second plurality of magnets substantially prevents a magnetic field generated from the first plurality of magnets and the second plurality of magnets from magnetically interfering with a magnetically sensitive device within a region that would otherwise be affected by the magnetic field.

Another aspect of the disclosure refers to a method of assembling a magnetically coupled device including engaging the first arrangement and the second arrangement, the engaging being limited to a single orientation, and positioning the first arrangement and the second arrangement to prevent a magnetic field generated from within the first plurality of magnets and the second plurality of magnets from affecting a magnetically sensitive component.

Another aspect of the disclosure refers to a method of producing a magnetically coupled device including determining a desired minimum thickness of a non-magnetic material, the desired minimum thickness being an amount of material required to prevent a device from being affected by the magnetic field when the first housing and the second housing are engaged, and forming the first housing and the second housing to have a thickness greater than the desired minimum thickness.

An advantage of embodiments of the present disclosure is that components can be attached and detached repetitively, quickly, and accurately.

Another advantage of embodiments of the present disclosure is that components sensitive to or otherwise susceptible to interference resulting from exposure to a strong magnetic field are not disrupted by the magnet arrangement in the magnetically coupled system.

Yet another advantage of embodiments of the present disclosure is that theatrical systems or performance systems including the magnetically coupled system can be modular and interchangeable.

Still yet another advantage of embodiments of the present disclosure is that welding, screwing, hammering, and other physical processes for fastening components together can be reduced or eliminated.

Further aspects of the method and system are disclosed herein. The features as discussed above, as well as other features and advantages of the present disclosure will be appreciated and understood by those skilled in the art from the following detailed description and drawings.

DESCRIPTION OF THE DISCLOSURE

Figure 1:
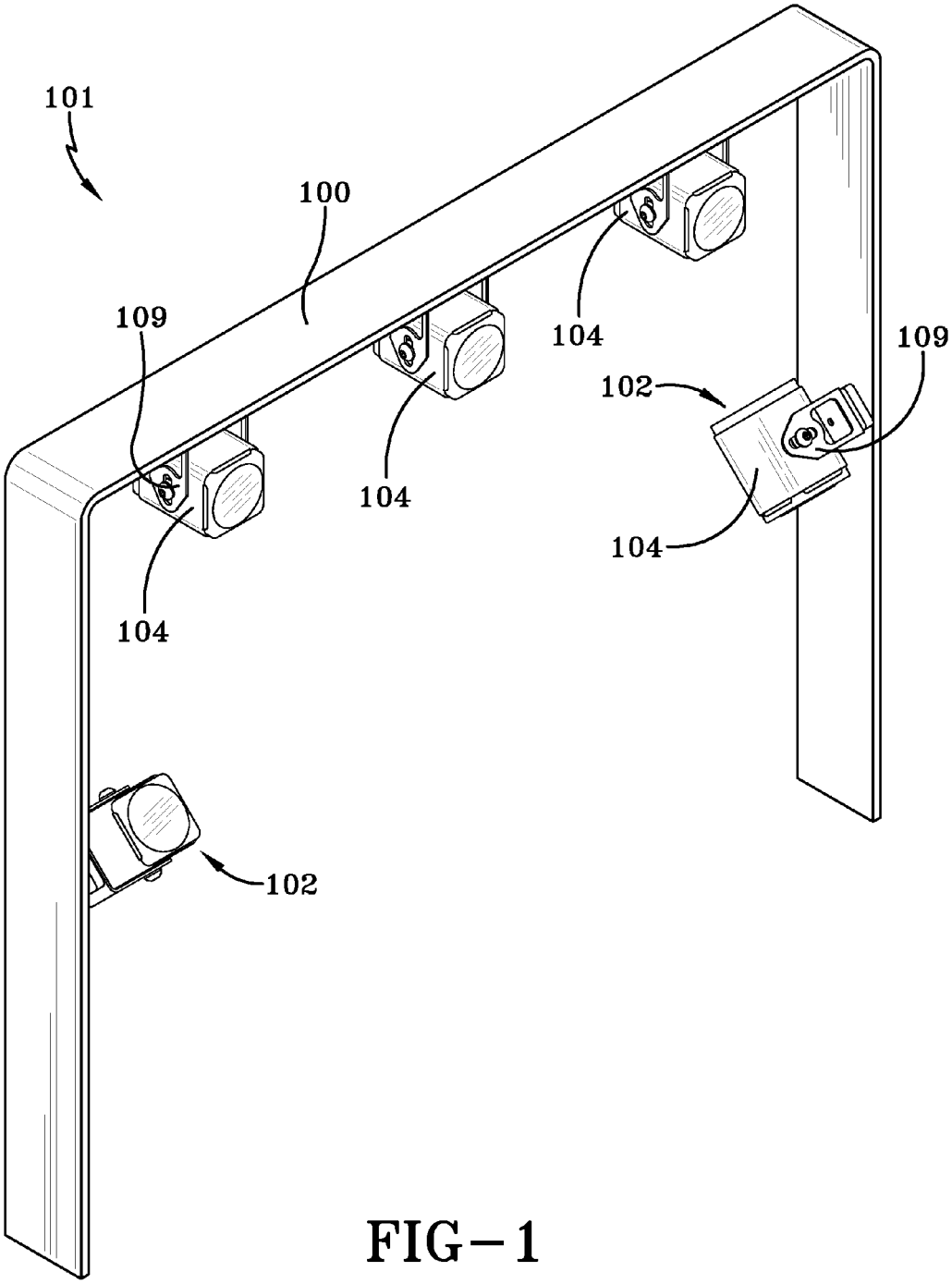
FIG. 1 shows a perspective view of an exemplary system including a plurality of magnetically coupled devices according to an embodiment of the disclosure.

FIG. 1 shows a magnetically coupled device 102 in a support structure 100 of a system 101. In one embodiment, coupled device 102 includes a component 104. Component 104 can be a magnetically sensitive component such as a sound component, a lighting component, and/or any other suitable component. A plurality of coupled devices 102 can be included within support structure 100. Coupled devices 102 can be positioned from above, from the side, or any other suitable orientation in support structure 100 or other suitable locations. Support structure 100 can be part of a multi-media system utilized in productions, such as theatrical events or concerts, and can include additional sound systems and/or lighting systems. For example, support structure 100 can be part of a theatrical system and/or a performance system. Support structure 100 can be permanent or temporary. Support structure 100 can further include components sensitive to magnetic interference. For example, support structure 100 can further include other magnetically sensitive components such as relays, wires carrying large currents, electrical instruments, inductors, and/or transformers. Magnetically sensitive devices are devices that experience altered operation or performance in the presence of strong magnetic fields. Such magnetic sensitivity may include loss of electronic signal quality, mechanical forces on device components, and/or altering of a device's range of motion or other performance parameter.

Figure 2:
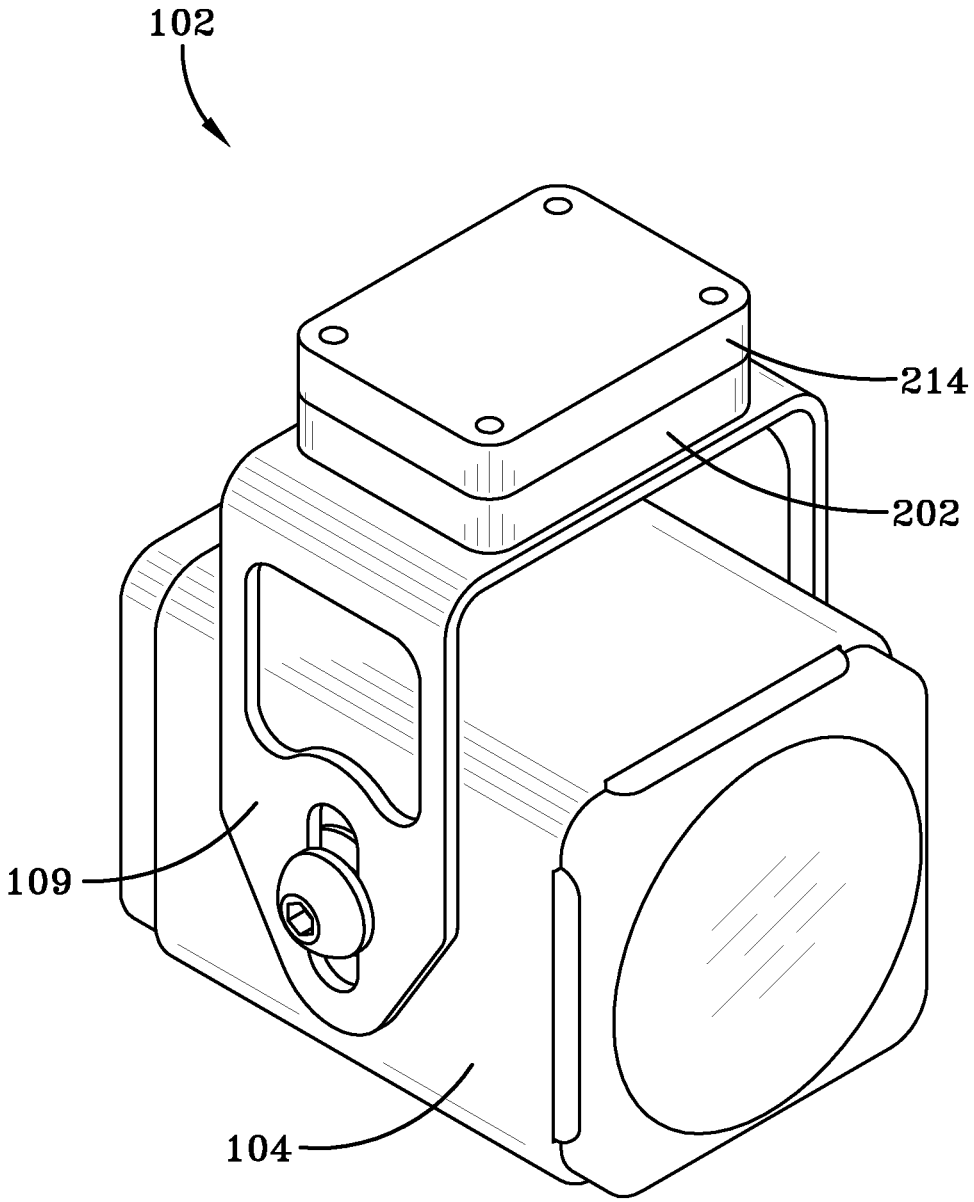
FIG. 2 shows a perspective view of an exemplary magnetically coupled devices according to an embodiment of the disclosure.
Figure 3:
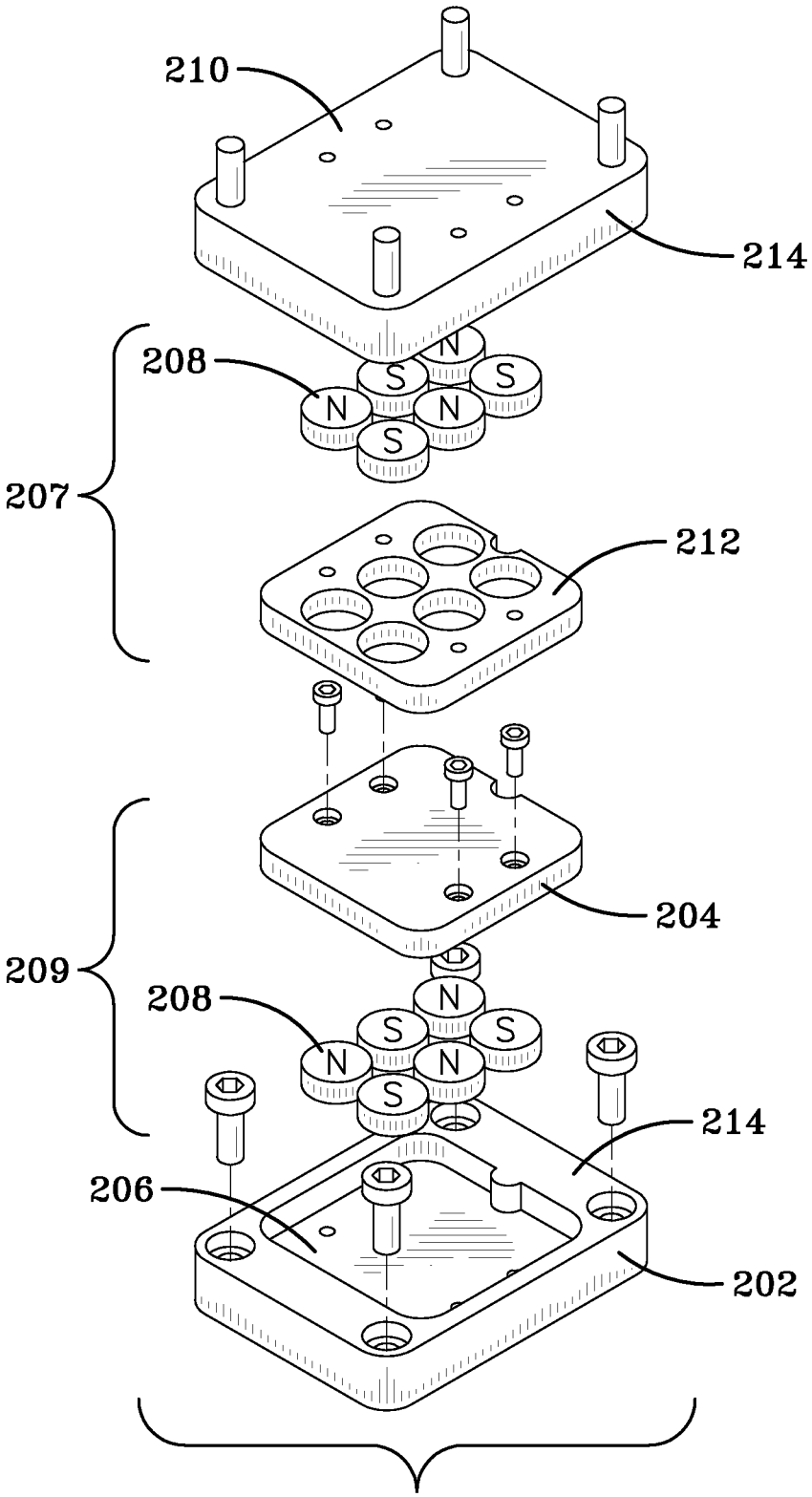
FIG. 3 shows an exploded perspective view of an exemplary magnetically coupled system according to an embodiment of the disclosure.

Referring to FIGS. 2 and 3, coupled device 102 can include a housing 202 and a housing 214. Housing 202 can be attached to component 104, a bracket 109, other suitable devices and/or structures, and combinations thereof. Housing 214 can be attached to system 101, support structure 100, or any other suitable structure. Housing 202 includes a first arrangement 209 of a first magnetic mounting member 204 and magnets 208, and housing 214 includes a second arrangement 207 of a second magnetic mounting member 212 and magnets 208. Housing 202, 214 can include features 206 for securing magnetic mounting member 204, 212 within housing 202, 214 and thus, magnets 208 in magnetic mounting member 204, 212. In one embodiment, feature 206 may be a snap or other suitable retention feature for securing magnet mounting member 204, 212 to housing 202, 214. In one embodiment, housing 202, 214 may include, but not be limited to, a plurality of fasteners for further securing magnets 208 to housing 202, 214. In another embodiment, housing 202, 214 may include molded recesses configured for receiving magnets 208. Molded recesses can be positioned to provide predetermined distances between magnets 208. The placement of magnets 208 can provide desired dimensions for reducing or eliminating magnetic interference as further described below. In another embodiment, housing 202, 214 may include adhesive for securing magnetic mounting member 204, 212 to housing 202, 214. Housing 202 and housing 214 can be detachably engaged by magnetic mounting member 204 by being magnetically coupled to magnetic mounting member 212.

Magnetic mounting members 204, 212 can be any suitable members configured to retain a plurality of magnets 208. Magnetic mounting members 204, 212 can be made of polymeric material or any other suitable material. It is desired that magnetic mounting member 204, 212 be resistant to having magnetic properties induced onto magnetic mounting members 204, 212. Magnets 208 can be any suitable magnetic material (for example, neodymium, samarium-cobalt, or ferrite) and can be arranged to provide additional alignment. It is desired that magnets 208 have high magnetic permeability. In one embodiment, magnetic mounting members 204, 212 may be the interlocking magnetic coupling members disclosed in U.S. patent application Ser. No. 12/363,006, filed Jan. 30, 2009, titled "INTERLOCKING MAGNETIC COUPLING MEMBERS," which is herein incorporated by reference in its entirety. As used herein, the term "interlocking magnetic coupling member" refers to the magnetic coupling members disclosed in U.S. patent application Ser. No. 12/363,006. Inclusion of the interlocking magnetic coupling members may provide interchangeability and/or modularity, assembly without the use of tools, and alignment to a specific position with a specific orientation.

Orienting magnets 208 North-South-North in a first row and South-North-South in a second row can prevent rotation of magnetic mounting member 204, 212. For example, if the magnets 208 in each magnetic mounting member 204, 212 are oriented in an arrangement of North-South in one row and South-North in another row, then alignment would be possible in two orientations (180 degrees apart). If only one magnet is included in each magnetic mounting member, then the magnetic mounting member could be rotated. In addition, including six magnets can permit sufficient magnetic attraction for supporting substantial weights (for example, more than about 10 pounds), can provide alignment, can prevent rotation, and can limit coupling to a single desired orientation.

Housings 202, 214 can reduce and/or eliminate the effect of a magnetic field outside of the housings 202, 214. Said another way, housing 202 and housing 214 can detachably engage, thereby encasing first arrangement 209 and second arrangement 207. Encasing first arrangement 209 and second arrangement 207 and/or positioning magnets 208 in such a region with such an arrangement can substantially prevent a magnetic field generated from within housing 202 and housing 214 from affecting a magnetically sensitive component that would otherwise be affected by the magnetic field. Housing 202, 214 can include a non-magnetic material 210 such as aluminum or any other suitable non-magnetic material. Including aluminum in housing 202, 214 may reduce or eliminate a range of a magnetic field generated by magnets 208. It is preferred that non-magnetic material 210 be resistant to having magnetic properties induced onto housing 202, 214.

Figure 4:
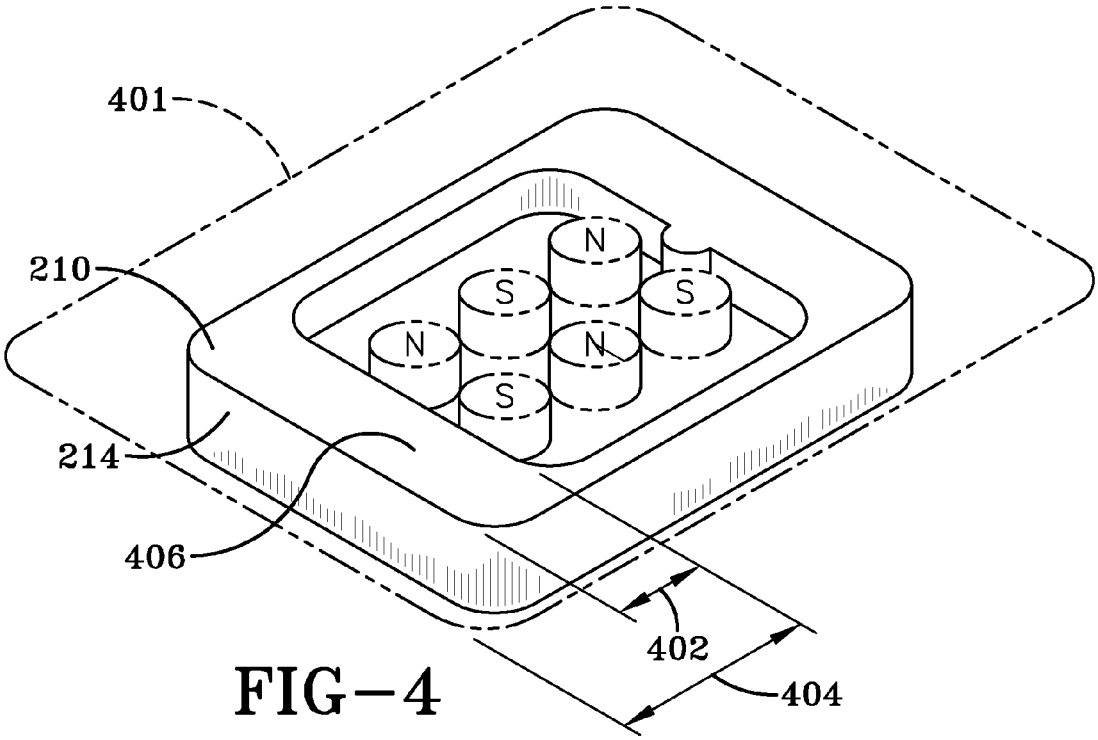
FIG. 4 shows a perspective view of an exemplary housing showing a region affected by a magnetic field.
Figure 5:
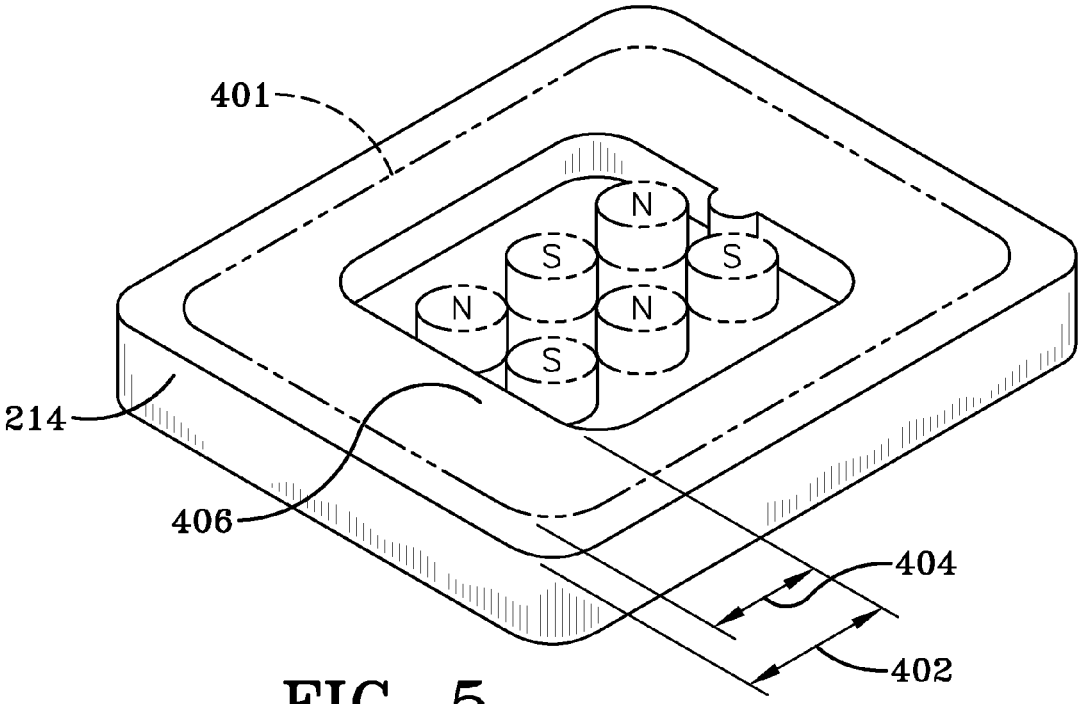
FIG. 5 shows a perspective view of an exemplary housing showing a region affected by a magnetic field.

Referring to FIGS. 4 and 5, non-magnetic material 210 can have a thickness 402 for preventing a magnetic field 401 from affecting magnetically sensitive components. Although magnetic field 401 is labeled in FIGS. 4-5, the depicted magnetic field is not intended to be a geometric representation of the actual magnetic field. To the contrary, the magnetic field may be much more complex. Furthermore, although not intending to be bound by theory, it is believed that the generated magnetic field may be directed such that it does not affect preselected regions. To prevent magnetic field 401 from affecting magnetically sensitive components, a desired minimum thickness at a preselected region 406 can be determined by monitoring whether a compass, iron filings, or other suitable device is affected by magnetic field 401 when housing 202 and housing 214 are engaged. Referring to FIG. 4, if the compass, iron filings, or other suitable device is affected, then thickness 402 of the non-magnetic material 210 at region 406 is less than magnetic effect distance 404 of magnetic field 401. Referring to FIG. 5, if the compass or other suitable device is not affected, then thickness 402 of non-magnetic material 210 at preselected region 406 is greater than magnetic effect distance 404. Preferably, these determinations are made in relation to similar regions on housing 202 and housing 214. These determinations can be repetitively performed with different regions in housing 202 and housing 214 thereby determining the minimum required thickness of material 210.

In another embodiment, corners on coupled device 102 may be eliminated based upon the desired dimensions of material 210. In one embodiment, these determinations may be repeated for handling changes in magnets used for coupled device 102. For example, if neodymium magnets of a specific strength are used, then neodymium magnets of a different strength are to be used, then similar determinations may be repeated. By repetitively determining a minimum thickness for non-magnetic material 210 at various regions, a desired configuration can be determined thereby permitting a design map to be created. The design map can reduce weight and cost of magnetically coupled device 102.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A magnetically coupled system comprising a magnetically coupled device, the magnetically coupled device comprising:

a first arrangement having a first plurality of magnets and a first mounting member disposed in a first housing, the first arrangement being attractable and alignable to a second arrangement having a second plurality of magnets and a second mounting member disposed in a second housing;

the first mounting member and the second mounting member further include molded recesses configured for receiving the magnets;

the first mounting member of the first arrangement being configured to detachably engage the second mounting member of the second arrangement in at least one predetermined orientation or position; and the first housing and the second housing including molded recesses configured for receiving the magnets and the first and second mounting members;

wherein positioning of the first mounting member and the second mounting member substantially prevents a magnetic field generated from the first plurality of magnets and the second plurality of magnets from magnetically interfering with the operation of a magnetically sensitive device within a region that would otherwise be affected by the magnetic field;

wherein the magnetically coupled device includes a magnetically sensitive component, wherein the first or second housing is attached by a bracket to a magnetically sensitive component.

2. The magnetically coupled system of claim 1, wherein the first plurality of magnets and the second plurality of magnets are disposed to provide alignment of the first arrangement and the second arrangement, and wherein the alignment consists of one orientation.

3. The magnetically coupled system of claim 1, wherein the first plurality of magnets and the second plurality of magnets each include two sets of magnets, wherein a first set is in north-south-north orientation and a second set is in south-north-south orientation.

4. The magnetically coupled system of claim 1, wherein the magnetically sensitive device is selected from the group consisting of relays, wires, electrical instruments, inductors, transformers, and combinations thereof.

5. The magnetically coupled system of claim 1, further comprising features on a first mounting to mechanically engage the first plurality of magnets within the housing.

6. The magnetically coupled system of claim 1, wherein the first arrangement and the second arrangement are interlocking magnetic coupling members.

7. The magnetically coupled system of claim 1, wherein the device supports a weight of at least about 10 pounds, provides alignment, prevents rotation, and limits coupling to a unitary desired orientation.

8. The magnetically coupled system of claim 1, wherein the first housing and the second housing comprise a non-magnetic material.

9. The magnetically coupled system of claim 1, wherein the first housing and the second housing comprise a non-ferrous material without ferromagnetic shielding.

10. The magnetically coupled system of claim 1, wherein magnetically interfering with the operation of the magnetically sensitive device includes loss of electronic signal quality.

11. The magnetically coupled system of claim 1, wherein magnetically interfering with the operation of the magnetically sensitive device includes at least one of applying mechanical forces onto device components and altering of a device's range of motion.

* * * * *